US006269994B1

(12) United States Patent
Harrington

(10) Patent No.: US 6,269,994 B1
(45) **Date of Patent: *Aug. 7, 2001**

(54) MANUAL TILE CUTTER

(75) Inventor: Patrick Harrington, Hertfordshire (GB)

(73) Assignee: North American Tile Tool Company, Florence, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/310,716

(22) Filed: May 12, 1999

(51) Int. Cl.[7] ..... B28D 1/24

(52) U.S. Cl. ..... 225/96.5; 225/96; 125/23.02; 83/886

(58) Field of Search ..... 225/96, 96.5, 104; 125/23.01, 23.02; 83/881, 886

(56) References Cited

U.S. PATENT DOCUMENTS

| | | | | |
|---|---|---|---|---|
| 1,932,659 | * | 10/1933 | Granite | 125/23.01 |
| 2,513,876 | | 7/1950 | Judd, Jr. . | |
| 3,242,786 | | 3/1966 | Giordano . | |
| 3,280,676 | | 10/1966 | Grzymislawski | 83/881 |
| 3,280,677 | | 10/1966 | Grzymislawski | 83/881 |
| 3,383,968 | | 5/1968 | Jagers . | |
| 3,399,586 | | 9/1968 | Insolio et al. | 83/881 |
| 3,459,078 | | 8/1969 | Black | 83/881 |
| 3,889,862 | | 6/1975 | Insolio et al. | 225/96.5 |
| 4,027,562 | | 6/1977 | Bonaddio | 83/8 |
| 4,096,773 | | 6/1978 | DeTorre | 83/8 |
| 4,098,155 | * | 7/1978 | Insolio | 83/8 |
| 4,104,939 | | 8/1978 | Bonaddio | 83/7 |
| 4,137,803 | | 2/1979 | Goldinger | 83/881 |
| 4,175,684 | | 11/1979 | Butler | 225/2 |
| 4,183,274 | | 1/1980 | Kingsley | 83/886 |
| 4,204,445 | | 5/1980 | Goldinger | 83/880 |
| 4,291,824 | | 9/1981 | De Torre | 225/2 |
| 4,385,540 | | 5/1983 | Dieter | 83/886 |
| 4,423,836 | * | 1/1984 | Hyatt | 225/96 |
| 4,881,439 | | 11/1989 | Biedermann et al. . | |
| 4,922,886 | * | 5/1990 | Hepworth | 125/23.01 |
| 5,040,445 | | 8/1991 | Liou . | |
| 5,303,690 | * | 4/1994 | Ishii | 125/23.01 |
| 5,381,713 | * | 1/1995 | Smith | 83/881 |
| 5,480,081 | | 1/1996 | Wilson et al. | 225/96.5 |
| 5,483,749 | * | 1/1996 | Hepworth | 125/23.02 |
| 5,560,274 | | 10/1996 | Turner . | |

FOREIGN PATENT DOCUMENTS

| | | | | |
|---|---|---|---|---|
| 0 494 578 A1 | * | 7/1992 | (EP) | 125/23.02 |
| 0 537 506 A1 | | 4/1993 | (EP) . | |
| 0932640 | * | 5/1962 | (GB) | 125/23.02 |
| 2 293 135 A | | 3/1996 | (GB) . | |
| 2 311 485 A | | 10/1997 | (GB) . | |
| WO 93/23216 | | 11/1993 | (WO) . | |

* cited by examiner

*Primary Examiner*—M. Rachuba
*Assistant Examiner*—Kim Ngoc Tran
(74) *Attorney, Agent, or Firm*—Wood, Herron & Evans, L.L.P.

(57) ABSTRACT

A manual tile cutter includes a base adapted to support a tile, a rail connected to the base above the tile and a carriage slidably mounted on the rail. A manually operated lever and a cutting toolholder are independently pivotally mounted to the carriage at a common pivot point. A shaft has one end mechanically coupled to the cutting toolholder and an opposite end extending through the carriage and connected to a manually adjustable knob. A biasing element applies a force on the cutting toolholder toward the tile. A height adjusting device in mechanical communication with the knob and the cutting toolholder adjusts the height of the cutting tool with respect to the tile but independent of the lever to accommodate different tile thicknesses.

20 Claims, 3 Drawing Sheets

MANUAL TILE CUTTER

BACKGROUND OF THE INVENTION

This invention relates to tile cutters and more particularly, to an improved manual tile cutter for maintaining a constant cutting force.

With a conventional tile cutter, a cutting or scoring tool, for example, a carbide cutting wheel, is operatively connected to a carriage which slides along a guide bar. The base of the tile cutter has a longitudinally, generally centrally spaced breaker bar or edge on which the tile rests with the breaker bar being positioned beneath the desired tile break line. A manual lever arm is also connected to the carriage and is used to move the carriage and the cutting wheel across the tile surface along a path defining where the tile is to be cut and broken. The cutting wheel cuts a shallow groove or score line in the tile surface along the desired break line. Resilient pads normally support the tile on either side of the breaker bar. After the tile is scored, the lever arm is manipulated to place breaker jaws or plates against the surface of the tile on both sides of the scored line located directly over the breaker bar. As downward pressure is applied to the handle, the breaker plates apply downward forces on the top surface of the tile on both sides of the breaker bar. Continued application of the force is effective to cause the tile to break into two pieces, preferably at a location defined by the score line or groove.

For high quality tile cutting, it is necessary that a consistent score line be cut on each and every tile. Thus, it is important that the tile cutter have the capability of providing a constant force on the scoring wheel during the scoring operation. If the scoring groove is of an insufficient depth, that is, is less than other lines of weakness in the tile structure, the tile may fracture and break in directions other than along the scoring line. If the scoring force is excessive, the carbide cutting wheel may be damaged or broken; or the glazed finished surface may chip away from the scoring line; or the tile may be crushed.

It is also important that the scoring force be adjusted for different tile thicknesses. As the tile thickness increases, there is a higher probability that lines of weakness within the tile structure will intersect or run close to the score line. And, there is a greater probability that the tile will break along a line of weakness other than the score line. To minimize that probability, the cutting wheel scoring force should be greater to produce a deeper score line so that it is the weakest line of weakness in the tile body. Thus, the cutting wheel scoring force and depth of score line should increase as the tile thickness increases.

There are numerous known tile cutter structures providing some regulation of scoring force. However, such known designs are often either complex and expensive to manufacture or somewhat unreliable in not providing a consistent desired scoring force for different tile thicknesses over the useful life of the tile cutter.

SUMMARY OF THE INVENTION

The present invention provides a manual tile cutter of a simple and inexpensive construction that is easily adjusted to score tiles of different thicknesses and automatically provides the proper scoring wheel cutting force with each tile regardless of the tile thickness.

In accordance with the principles of the present invention and the described embodiments, the present invention is a manual tile cutter having a base adapted to support a tile. A rail is connected to the base above the tile and has a carriage slidably mounted thereon. A manually operated lever is pivotally mounted to the carriage at a pivot point, and a cutting toolholder having a rotatably mounted cutting tool is pivotally mounted to the carriage at the same pivot point. The lever and cutting toolholder are not connected together, and therefore, the cutting toolholder is free to pivot independent of a pivoting action of the lever. A shaft has one end mechanically coupled to the cutting toolholder and an opposite end extending through the carriage. A manually adjustable knob is connected to the opposite end of the shaft, and a biasing element applies a biasing force on the cutting toolholder toward the tile. A height adjusting device in mechanical communication with the knob and the cutting toolholder adjusts the height of the cutting tool with respect to the tile independent of the lever to accommodate different tile thicknesses.

These and other objects and advantages of the present invention will become more readily apparent during the following detailed description taken in conjunction with the drawings herein.

DETAILED DESCRIPTION OF THE INVENTION

Figure 1:
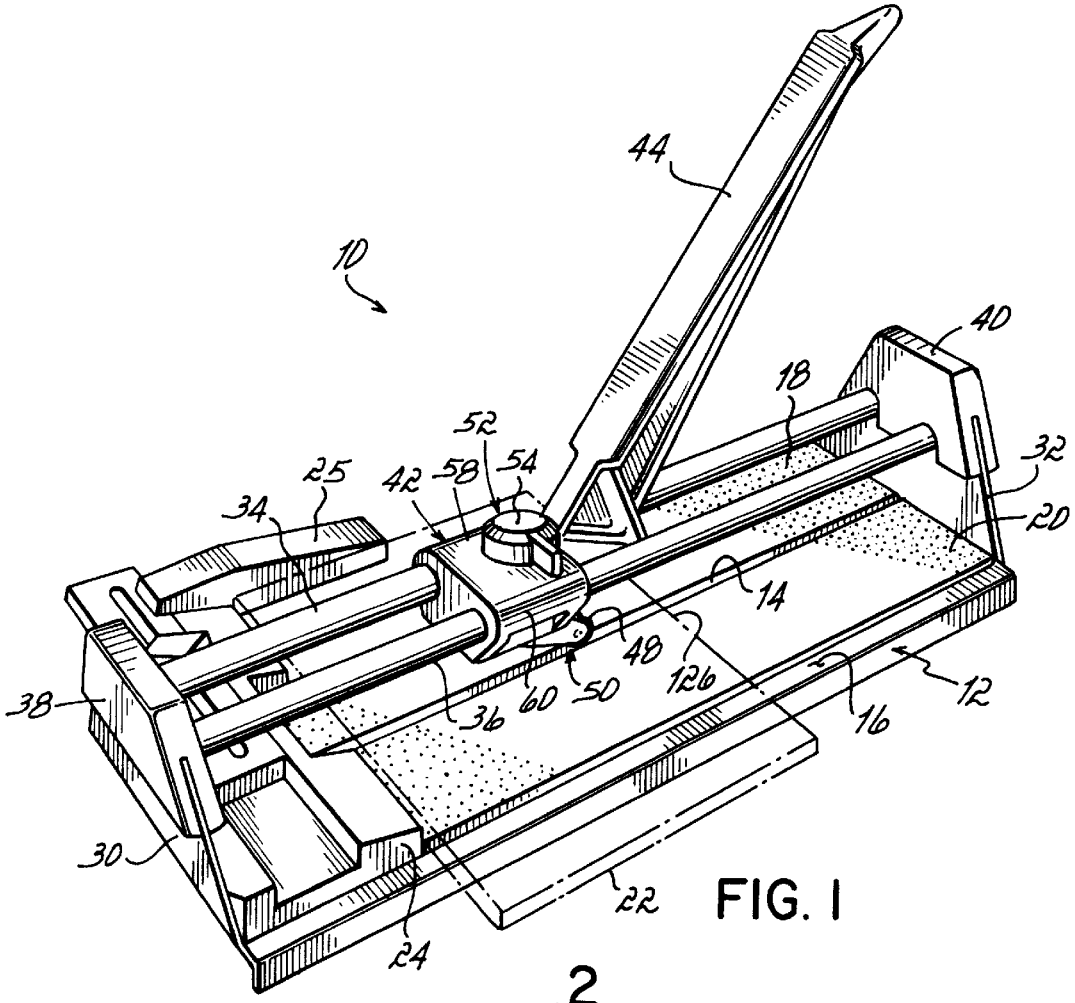
FIG. 1 is a perspective view illustrating a preferred embodiment of the tile cutter in accordance with the principles of the present invention.

Referring to FIG. 1, a tile cutter 10 is comprised of a generally rectangular base 12 which has a breaker bar, or breaker edge 14 extending centrally and longitudinally over the base 12. The breaker bar 14 normally has a length equal at least to the length of the longest tile to be cut on the cutter 10. The base 12 typically rests on a generally horizontal support surface. The breaker bar 14 projects a predetermined distance above the top surface 16 of the base 12. On both sides of the breaker bar 14 and extending substantially over the entire upper surface 16 of the base 12 are pads 18, 20, which help support a tile 22 to be cut. The pads 18, 20 may be made of any material that provides a resilient support for the tile 22 during the scoring and breaking process.

The tile cutter 10 further includes alignment blocks, for example, a fixed alignment block 24 and an adjustable alignment block 25. End supports 30, 32 have a lower end rigidly connected at each end of the base 12 and extend in a generally perpendicular direction away from the top surface 16 of the base 12. A pair of guide rails 34, 36 are connected to guide rail supports 38, 40 which are connected to the upper end of the end supports 30, 32. The guide rails 34, 36 are mounted to be substantially parallel to the breaker bar 14 on the base 12. A carriage 42 is slidably mounted on the guide rails 34, 36.

Figure 2:
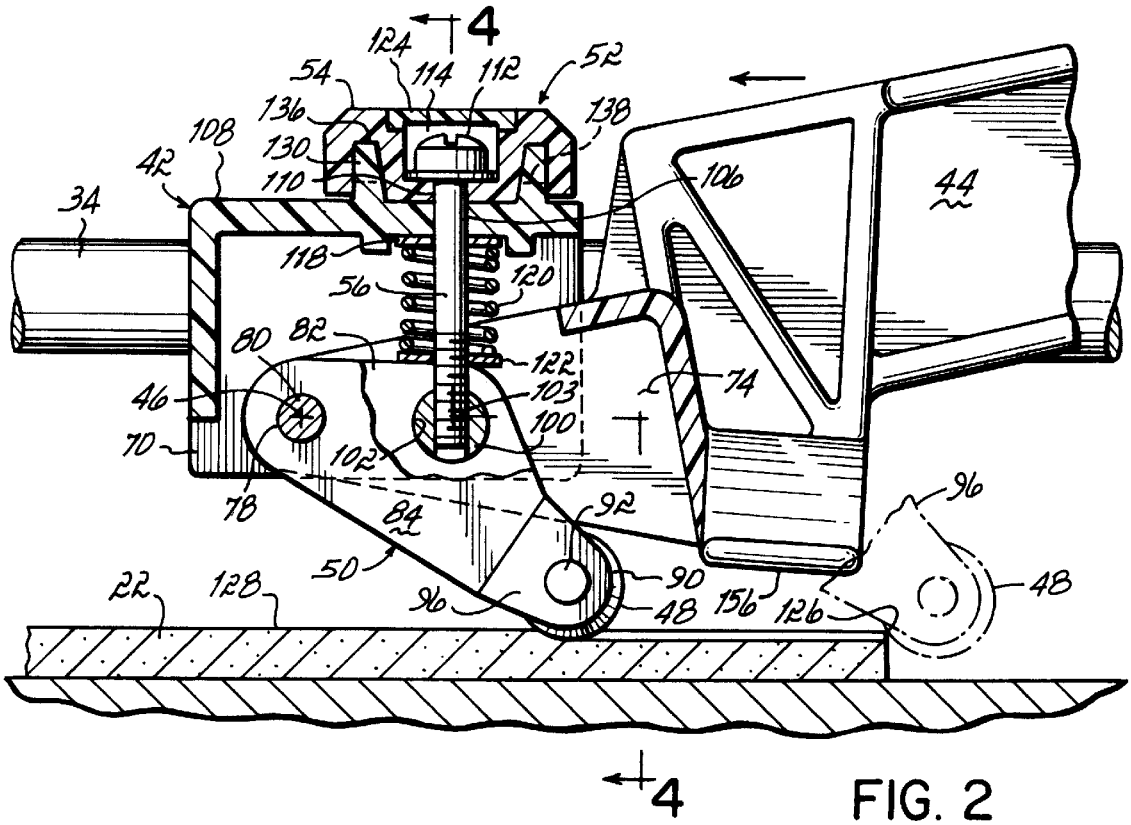
FIG. 2 is a longitudinal cross-sectional view of the carriage taken along line 3—3 of FIG. 1 in illustrating the height adjusting device in a first position.
Figure 3:
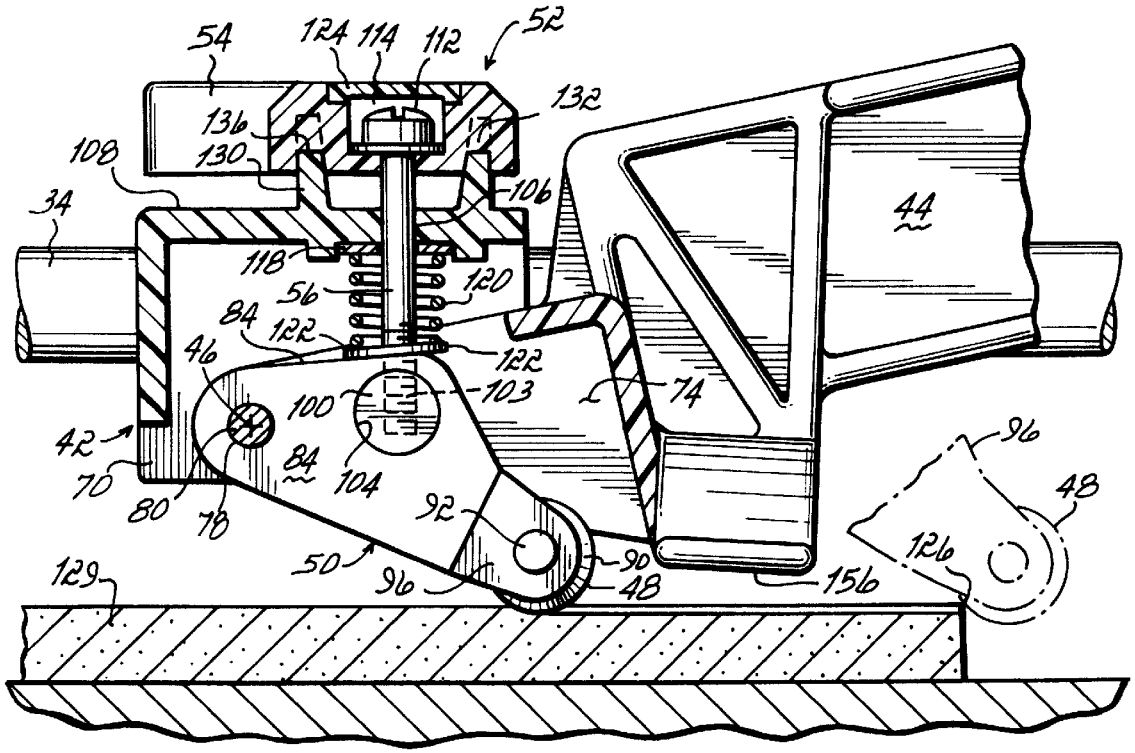
FIG. 3 is a cross-sectional view of the carriage similar to FIG. 2 and illustrating the height adjusting device in a second position.

Referring to FIG. 2, a manually operated lever 44 is pivotally connected to the carriage 42 at a pivot axis 46 which is below the elevation of the guide rails 34, 36. One end of a tool holder 50 is pivotally mounted on the pivot axis 46 independent of the lever 44. Thus, the lever 44 and tool holder 50 rotate independently of each other on pivot axis 46. A cutting tool, for example, a carbide scoring wheel 48 is rotatably mounted to one end of a tool holder 50. The height or elevation of the cutting wheel 48 with respect to the tile 22 is controlled by a height adjusting mechanism 52 including a manually rotatable knob 54. As will be subsequently explained, rotating the knob 54 changes the elevation of an adjusting shaft or screw 56 which in turn moves the tool holder 50 and cutting wheel 48 to a different height as illustrated in FIG. 3.

Figure 4:
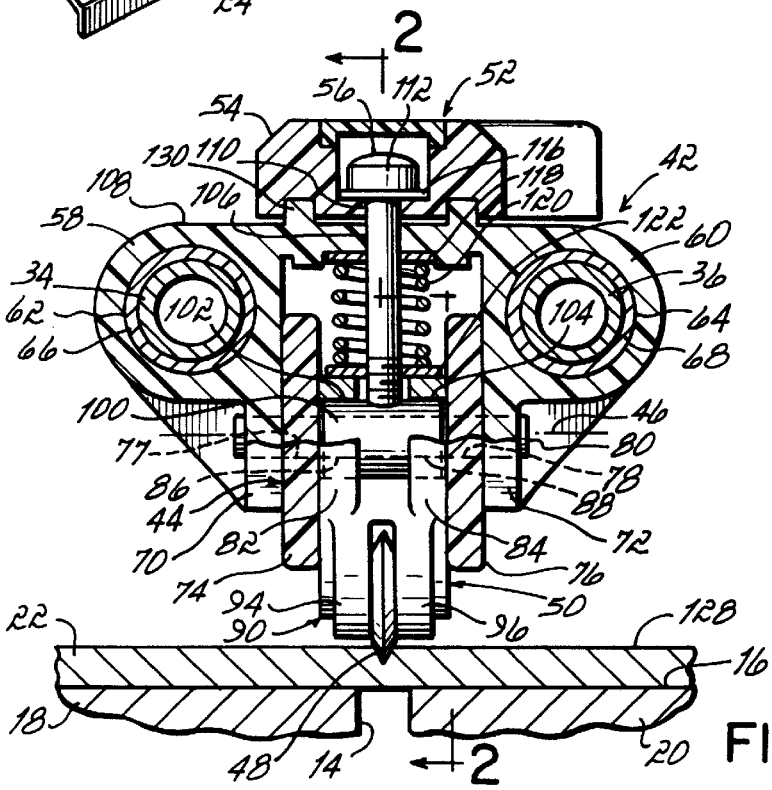
FIG. 4 is a cross-sectional end view taken along line 4—4 of FIG. 2 and illustrating the pivotal connection of the lever and cutting tool holder to the carriage.
Figure 5:
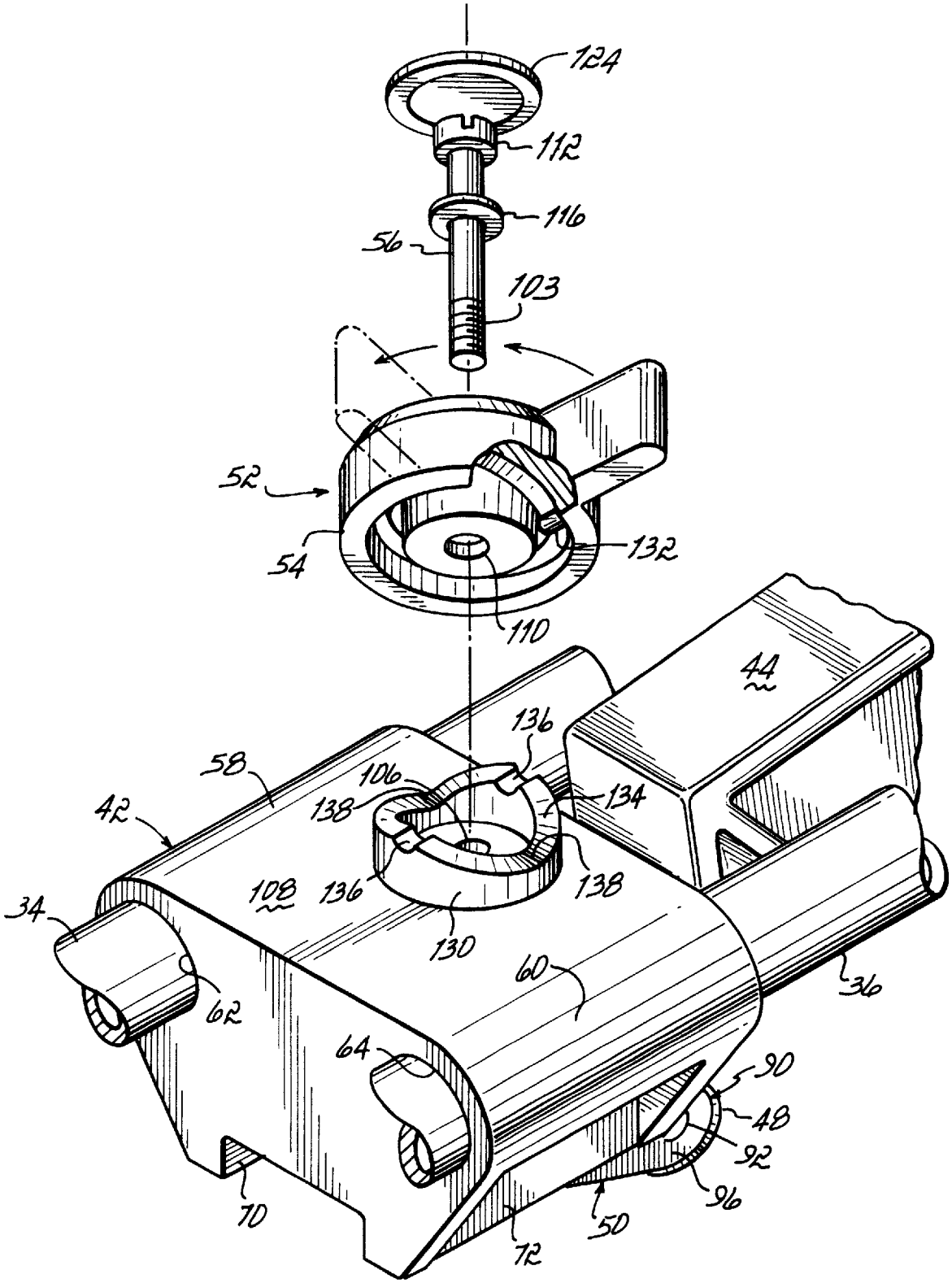
FIG. 5 is a disassembled perspective view illustrating one embodiment of a tile height adjusting device in accordance with the principles of the present invention.

Referring to FIG. 5, the carriage 42 has shoulders 58, 60 which contain respective guide rail bores 62, 64. Each of the guide rail bores 62, 64 are sized to receive respective bearings 66, 68 which in turn, slide on the respective rails 34, 36. The carriage 42 further includes opposed identical projections 70, 72 which extend downward from the perspective shoulders 58, 60 toward the base 12. The pivot axis 46 is implemented using a pivot pin or shaft 80 that extends between and is secured to the projections 70, 72 of the carriage 42. The lever 44 has a forked end with opposed legs 74, 76 with respective bores 77, 78 that are sized to rotatably receive the pivot pin 80. The tool holder 50 has opposed shoulders 82, 84 which fit between the respective legs 74, 76 of the lever 44. The pivot pin 80 is rotatably received within the bores 86, 88 in the respective shoulders 82, 84 of the tool holder 50. Thus, the lever 44 and the tool holder 50 pivot freely and independently on the pivot pin 80. An opposite end of the tool holder 50 has a forked end 90. The scoring wheel 48 is rotatably mounted on an axle 92 (FIG. 2), and the ends of the axle 92 are securely mounted in the legs 94, 96 of the tool holder forked end 90 (FIG. 4). Thus, the scoring wheel 48 rotates freely with respect to the tool holder 50.

The height adjusting screw 56 has a lower end that extends between the shoulders 82, 84 of the tool holder 50 and is connected to an axle 100 that is rotatably mounted within bores 102, 104 (FIGS. 2 and 3) of the respective shoulders 82, 84 of the tool holder 50. Referring to FIG. 2, the lower end 103 of the adjusting screw 56 is threaded into the axle 100. The upper end of the adjusting screw 56 extends through a hole 106 in the top 108 of the carriage 42 and then through a hole 110 in the bottom of the knob 54. The upper end of the screw 56 has an enlarged head portion 112 located within a cavity 114 of the knob 54. The screw 56 passes through a centering washer 116 in the cavity 114 to properly locate the screw 56 with respect to the knob 54. A second centering washer 118 locates the adjusting screw 56 with respect to the carriage 42. The centering washer 118 further provides an upper bearing surface for a biasing element, for example, a compression spring, 120. A lower bearing surface is provided by a washer 122. The cavity 114 within the knob 54 is covered by a cap 124.

The threaded engagement of the screw 56 into the axle 100 provides two functions. First, rotating the screw 56 raises and lowers the tool holder 50 and cutting wheel 48 with respect to the carriage 42 and the tile 22. Normally when the cutting wheel 48 is not engaged with the tile as shown in phantom in FIG. 2, the tool holder 50 should be at a height such that as the carriage is moved to the left as illustrated in FIG. 2, the cutting wheel 48 and not the tool holder 50, engages the edge 126 of the tile. Thus, with continued motion of the carriage 42, as the cutting wheel 48 engages the edge 126, it easily rides up onto the upper surface 128 of the tile 22. Adjusting the screw 56 also adjusts the biasing or scoring force applied by the spring 120 on the cutting wheel 48, that is, a force resisting motion of the cutting wheel 48 in the upward direction.

As shown in FIG. 2, a tile of a first thickness, for example, 0.250 inches, can be scored and broken. Referring to FIGS. 3 and 5, a tile 129 of greater thickness, for example, 0.375 inches, may be scored and broken. To accommodate the thicker tile 129, the tile cutter 10 includes a tile thickness adjusting mechanism 52 comprising a fixed cam 130 mounted on the top 108 of the carriage 42 and a movable cam follower 132 mounted within the knob 54. The fixed cam 130 has an undulating annular cam surface 134 with two diametrically opposed upper positions defined by detents 136 and two diametrically opposed lower positions 38. The upper positions 136 are angularly separated from the lower positions 138 by approximately 90°. With the knob in the position illustrated in FIG. 2, the cam follower 132 is located at a lower position 138 on the surface 134. By rotating the knob 54 90° to the position shown in phantom in FIGS. 3 and 5, the cam follower 132 is moved to the upper position detent 136 on the surface 134. The vertical distance or elevation between the bottom of the detent 136 and lower position 138 on the cam surface 134 corresponds to the difference in thickness between the tiles 22, 129.

As the cam follower 132 moves from the lower position 138 along the surface 134 toward the upper position 136, the knob 54 is lifted vertically upward with respect to the breaker bar 14 on the base 12. As the knob 54 elevates, the screw 56 also elevates, thereby lifting the tool holder 50 and the cutting wheel 48. When the cam follower 132 engages the upper position detent 136, the rotation of the knob 54 is stopped; and the cutting tool 48 is at an elevated position as illustrated in FIG. 3. As the cutting wheel 48 and tool holder 50 elevate, the compression spring 120 is compressed, thereby applying a greater biasing or scoring force on the cutting wheel 48. The greater scoring force will provide a deeper scoring groove to facilitate cutting the thicker tile 129.

In use, the lever 44 and carriage 42 are pulled toward the end 32 of the base 12. A tile is then placed against the alignment block 24 with the desired score line or break line aligned with the breaker bar 14. The knob 54 is rotated to provide a height of the cutting wheel 48 to match the thickness of the tile being cut. By pushing the handle 44 horizontally but not downward, the carriage 42 is moved along the rails 34, 36 toward the end 30 of the base 12. The scoring wheel 48 initially engages the edge 126 of the tile and rides up onto the upper surface 128 of the tile. The spring 120 provides a downward scoring force on the cutting wheel 48 such that, as the cutting wheel 48 moves across the tile, a scoring groove of the desired depth is cut. A continued pushing on the handle 44 causes the scoring wheel 48 to move completely across the tile and drop into a pocket 134 of the alignment bar 24. The handle 44 is then lowered so that the breaker plates 156 contact the tile on either side of the breaker bar 14. Continued downward pressure on the lever arm 44 will cause the tile to break over the breaker bar 14 along the score line.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, while the adjustment screw 56 is disclosed as threadedly engaging the axle 100, which is rotatably mounted within the tool bar 50. As will be appreciated, if the springs 120 on different tile cutters have relatively consistent spring constants, the adjusting screw 56 will be adjusted to have the same length between its head 112 and the tool holder 50. Therefore, alternatively, the adjusting screw 56 can be nonthreadedly fixed into the tool holder 50 to provide the desired length. Further, as will be appreciated, instead of the axle 100 being rotatably mounted in the tool holder, alternatively, the axle can be fixed within the tool holder 50 or eliminated altogether and the lower end of the shaft 56 fixed by welding, adhesives or other connecting agents at its correct length between the shoulders 82, 84 of the tool holder 50.

The spring 120 may be any type of device that provides the desired biasing force, that is, a resistance to the cutting wheel 48 moving in the upward direction. Therefore, the spring 120 could be replaced by one or more Belleville washers, a leaf spring, a bushing made from rubber or other elastic material, etc. Further, the height adjusting mechanism 54 is described as having two height adjustments which are separated by a 90° rotation of the knob 54. As will be appreciated, other cam detents can be provided in the cam surface 134 so that the cutting wheel 48 can be adjusted to three or more heights. Alternatively, the cam 130 and cam follower 132 may be eliminated; and instead, the knob 54 fixed to the adjusting screw 56. Thus, by rotating knob 54 and adjusting screw 56, the cutting wheel 48 is raised and lowered to different heights to accommodate different tile thicknesses. With that embodiment, the height of the cutting wheel 48 is infinitely adjustable.

Therefore, the invention in its broadest aspects is not limited to the specific details shown and described. Consequently, departures may be made from the details described herein without departing from the spirit and scope of the claims which follow.

What is claimed is:

1. A manual tile cutter comprising:

a base adapted to support a tile;

a rail connected to the base above the tile;

a carriage slidably mounted on the rail;

a lever pivotally mounted to the carriage at a pivot point;

a cutting toolholder pivotally mounted to the carriage at the pivot point, the cutting toolholder being pivotable independent of the lever;

a cutting tool rotatably mounted to the cutting toolholder;

a shaft having one end mechanically coupled to the cutting toolholder and an opposite end extending through the carriage;

a manually adjustable knob connected to the opposite end of the shaft;

a biasing element applied to the cutting toolholder for applying a biasing force on the cutting tool toward the tile; and a height adjusting device operatively connected with the knob and the cutting toolholder for varying the biasing force on the tool and the height of the cutting tool with respect to the base independent of the lever.

2. A manual tile cutter of claim 1 wherein the lever pivots about the pivot point independently of the cutting toolholder.

3. A manual tile cutter of claim 1 wherein the cutting toolholder has one end pivotally mounted to the carriage and an opposite end rotatably receiving the cutting wheel.

4. A manual tile cutter of claim 1 further comprising a pivot pin having opposed ends fixed to the carriage.

5. A manual tile cutter of claim 4 wherein the lever has one pivotally mounted to the pivot pin.

6. A manual tile cutter of claim 5 wherein the cutting toolholder is pivotally mounted to the pivot pin for pivoting motion independent of the lever.

7. A manual tile cutter of claim 4 wherein the one end of the shaft is connected to the pivot pin.

8. A manual tile cutter of claim 7 wherein the one end of the shaft is threadedly connected to the pivot pin.

9. A manual tile cutter of claim 1 wherein the biasing element is an element resisting motion of the cutting tool in a generally upward direction.

10. A manual tile cutter of claim 9 wherein the biasing element extends between the cutting toolholder and an interior surface of the carriage.

11. A manual tile cutter of claim 9 wherein the biasing element is an elastic element.

12. A manual tile cutter of claim 9 wherein the biasing element is a spring.

13. A manual tile cutter of claim 12 wherein the spring is a compression spring.

14. A manual tile cutter of claim 12 wherein the spring is a group of Belleville washers.

15. A manual tile cutter of claim 1 wherein the height adjusting device is a stationary cam and a movable cam follower.

16. A manual tile cutter of claim 15 wherein the stationary cam is on the carriage and the cam follower is on the manually adjustable knob.

17. A manual tile cutter of claim 16 wherein the stationary cam further comprises:

a first surface associated with a first tile thickness, and a second surface associated with a second tile thickness.

18. A manual tile cutter of claim 17 wherein the cam follower is movable to the first surface to move the toolholder to a first height with respect to the base for scoring a tile of the first thickness with a first biasing force.

19. A manual tile cutter of claim 18 wherein the cam follower is movable to the second surface to move the toolholder to a second height with respect to the base for scoring a tile of the different thickness with a second biasing force.

20. A manual tile cutter of claim 1 wherein the height adjusting device varies the biasing force in proportion with the height of the cutting tool.

* * * * *